US010435992B2

(12) United States Patent
Carmody et al.

(10) Patent No.: US 10,435,992 B2
(45) Date of Patent: Oct. 8, 2019

(54) SYSTEM AND METHOD FOR REMOVING A LINER OVERLAP AT A MULTILATERAL JUNCTION

(71) Applicant: BAKER HUGHES INCORPORATED, Houston, TX (US)

(72) Inventors: Michael Carmody, Houston, TX (US); Joseph Sheehan, Cypress, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 1119 days.

(21) Appl. No.: 14/491,050

(22) Filed: Sep. 19, 2014

(65) Prior Publication Data

US 2016/0084047 A1 Mar. 24, 2016

(51) Int. Cl.
*E21B 41/00* (2006.01)
*E21B 23/03* (2006.01)

(52) U.S. Cl.
CPC ..... *E21B 41/0035* (2013.01); *E21B 23/03* (2013.01); *E21B 41/0042* (2013.01)

(58) Field of Classification Search
CPC ... E21B 41/0035; E21B 41/0042; E21B 23/03
See application file for complete search history.

(56) References Cited

U.S. PATENT DOCUMENTS 6,209,648 B1 * 4/2001 Ohmer ..... E21B 41/0042 166/255.3
2002/0000319 A1 * 1/2002 Brunet ..... E21B 23/002 166/313
2003/0127232 A1 * 7/2003 Bussear ..... E21B 34/14 166/373
2004/0035581 A1 * 2/2004 Cavender ..... E21B 41/0042 166/313
2005/0167112 A1 * 8/2005 Smith ..... E21B 41/0042 166/313
2012/0261130 A1 * 10/2012 Linn ..... E21B 41/0035 166/313
2013/0333876 A1 * 12/2013 Dancer ..... E21B 17/08 166/242.6

* cited by examiner

*Primary Examiner* — Robert E Fuller
*Assistant Examiner* — Christopher J Sebesta
(74) *Attorney, Agent, or Firm* — Parsons Behle & Latimer

(57) ABSTRACT

A lateral junction liner system may include a liner sleeve proximate to a junction between a lateral bore and a main bore of a well. The liner sleeve may be movable between a first position and a second position. The liner sleeve may separate an upper section of the main bore from a lower section of the main bore while in the first position. The lateral junction liner may further include a liner positioned at least partially within the lateral bore and in contact with the liner sleeve. The lateral junction liner system may also include a lock mechanism attached to the liner sleeve that, when enabled, retains the liner sleeve in the first position and that, when disabled, enables selective displacement of the liner sleeve from the first position to the second position.

22 Claims, 4 Drawing Sheets

SYSTEM AND METHOD FOR REMOVING A LINER OVERLAP AT A MULTILATERAL JUNCTION

FIELD OF THE DISCLOSURE

The present disclosure relates to removing a liner overlap at a multilateral junction, and more particularly to installing a lateral junction assembly at a lateral junction of a well using a lateral junction liner system.

BACKGROUND

As the need for increased production capacity in oil and gas wells increases, additional bores (e.g., lateral bores) may be branched off a main bore of a well creating a lateral junction (e.g., a multilateral junction) within the well. The lateral bore is often an open-hole bore drilled after completion of the main bore. During the formation of the lateral bore, drilled material and/or debris may potentially enter the main bore causing damaging and clogging installed completion equipment. Further, the lateral bore may be an open-hole bore and may require support to prevent collapsing of the bore wall and to prevent contaminants from entering the bore.

During formation of the lateral bore, a dropped-off liner may be positioned in the lateral open-hole bore to support and protect the bore. The dropped-off liner may be coupled to a lateral junction assembly. During the installation of the dropped-off liner and additional completion structures within the lateral bore, a temporary liner is often run across the lateral junction. The temporary liner is removed before installing the lateral junction assembly. Removing the temporary liner takes time and resources and may increase a risk to operators of the drilling and completion equipment. A liner system is needed that does not have to be removed from a well when a lateral junction assembly is installed.

SUMMARY

Disclosed are systems, apparatus, and methods from removing a liner overlap at a multilateral junction that may resolve some of the disadvantages discussed above.

In an embodiment, a lateral junction liner system includes a liner sleeve proximate to a junction between a lateral bore and a main bore of a well. The liner sleeve is movable between a first position and a second position. The liner sleeve separates an upper section of the main bore from a lower section of the main bore while in the first position. The system further includes a liner positioned at least partially within the lateral bore and in contact with the liner sleeve. The system also includes a lock mechanism attached to the liner sleeve that, when enabled, retains the liner sleeve in the first position and that, when disabled, enables selective displacement of the liner sleeve from the first position to the second position.

In an embodiment, the lock mechanism comprises a shear ring coupling the liner sleeve to the liner. The shear ring may be disabled by a straight pull at the liner sleeve, by rotation of the liner sleeve, by an internal pressure of the liner sleeve, or by a combination thereof. The lock mechanism may include a j-type mechanical latch, a mechanically or hydraulically activated hydrostatic chamber, or a combination thereof.

In an embodiment, a portion of the liner sleeve resides outside the liner when the liner sleeve is in the first position and resides inside the liner when the liner sleeve is in the second position.

In an embodiment, the liner includes a window defined therein. The window may be overlapped by at least a portion of the liner sleeve while the liner sleeve is in the first position. The portion of the liner sleeve may not overlap the window while the liner sleeve is in the second position.

In an embodiment, the liner sleeve supports an open-hole section of at least one of the main bore and the lateral bore while in the first position.

In an embodiment, a liner apparatus includes a tubular liner proximate to a junction between a lateral bore and a main bore of a well. The tubular liner extends into the lateral bore. The apparatus further includes a barrier portion of the tubular liner that separates an upper section of the main bore from a lower section of the main bore. The barrier portion is configured to break predictably when expanded.

In an embodiment, the barrier portion is configured to break in response to receiving a swage through the tubular liner. Breaking the barrier portion may form an opening at the barrier portion of the tubular liner. The opening may unseparate the upper section of the main bore and the lower section of the main bore. The barrier portion may be configured to expand upon breaking to enlarge the opening.

In an embodiment, the barrier portion includes one or more support bands, a thin section of material, a pre-stress induced location, or a combination thereof.

In an embodiment, a method of installing a lateral junction assembly at a lateral junction of a well includes positioning a liner and a liner sleeve proximate to a junction between a lateral bore and a main bore of a well. The liner sleeve is movable between a first position and a second position. The liner sleeve separates an upper section of the main bore from a lower section of the main bore while in the first position. The liner is positioned at least partially within the lateral bore and the liner is in contact with the liner sleeve. The method further includes disabling a lock mechanism coupled to the liner sleeve. The lock mechanism, when enabled, retains the liner sleeve in the first position and, when disabled, enables selective displacement of the liner sleeve from the first position to the second position. The method also includes displacing the liner sleeve to the second position to unseparate the upper section of the main bore and the lower section of the main bore. At least a portion of the liner sleeve is within the lateral bore while the liner sleeve is at the second position.

In an embodiment, disabling the lock mechanism includes disabling a shear ring coupling the liner sleeve to the liner. Disabling the shear ring may include performing a straight pull operation at the liner sleeve, performing a rotation operation at the liner sleeve, applying an internal pressure at the liner sleeve, or a combination thereof.

In an embodiment, disabling the lock mechanism includes receiving an object at the liner sleeve and shifting a release dog in response to the object. The object may include at least one of a ball, a dart, and a downhole tool. The object may be formed from a metal, a polymer, a dissolvable composite epoxy material, or a combination thereof.

In an embodiment, disabling the lock mechanism includes generating a trigger at an electronic circuit of the locking mechanism and disabling the lock mechanism in response to the trigger. The electronic trigger may be generated in response to expiration of a timer, measuring a predetermined temperature at the liner sleeve, measuring a predetermined pressure at the liner sleeve, receiving a magnetic dart at the liner sleeve, or a combination thereof.

In an embodiment, displacing the liner sleeve to the second position may include sliding at least a portion of the liner sleeve into the lateral bore. Displacing the liner sleeve to the second position may include sliding at least a portion of the liner sleeve into the liner. Displacing the liner sleeve to the second position may include sliding at least a portion of the liner. Displacing the liner sleeve to the second position may include sliding at least a portion of a lateral completion. Displacing the liner sleeve to the second position is performed using wireline or coil tubing tools. Displacing the liner sleeve may remove at least a portion of an overlap between the liner sleeve and a window defined within the liner.

In an embodiment, the method may further include attaching the liner sleeve to a lateral junction assembly at a docking mechanism of the liner sleeve. The method may also include running the lateral junction assembly to the lateral junction. Running the lateral junction assembly may push the liner sleeve from the first position to the second position.

In an embodiment, a method of installing a lateral junction assembly at a lateral junction of a well includes positioning a liner proximate to a junction between a lateral bore and a main bore of a well. The liner extends into the lateral bore. A barrier portion of the liner separates an upper section of the main bore from a lower section of the main bore. The liner includes one or more support bands positioned along the barrier portion of the liner. The method further includes breaking the one or more support bands to form an opening in the liner. The opening unseparates the upper section of the main bore and the lower section of the main bore.

In an embodiment, the method includes receiving a swage through the liner. The one or more support bands may be broken in response to the swage. The method may also include expanding the one or more support bands to enlarge the opening in the liner.

Figure 1:
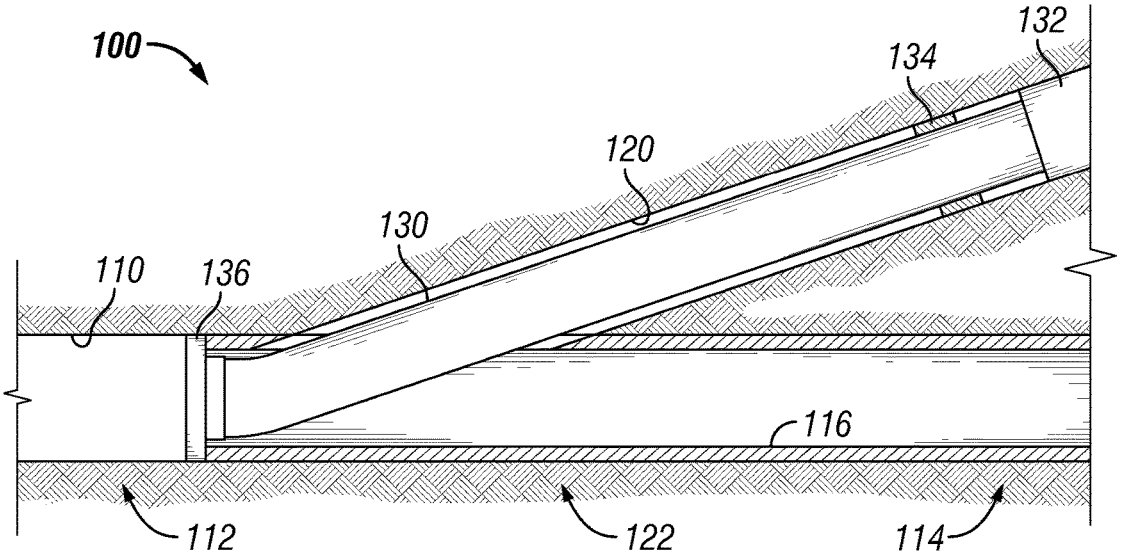
FIG. 1 depicts an embodiment of a lateral liner junction system in a first configuration.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

Referring to FIG. 1, an embodiment of a lateral liner junction system 100 in a first configuration is depicted. The lateral liner junction system 100 may be positioned at a lateral junction 122 of a well and may be located at least partially within a main bore 110 and at least partially within a lateral bore 120. In an embodiment, the well is a multilateral well and the lateral junction 122 is a multilateral junction (MU) of the well. The well may be used to extract naturally occurring resources from the ground such as crude oil, natural gas, water, minerals, other types of extractable resources, or a combination thereof.

The main bore 110 may be divided into sections. For example, the main bore 110 may include an upper section 112 and a lower section 114. The upper section 112 may include a portion of the main bore 110 located between a wellhead (e.g., an entrance) of the well and the lateral junction 122. The lower section 114 may include a portion of the main bore 110 located further downhole from the lateral junction 122.

As shown in FIG. 1, the main bore 110 may include a casing 116. The casing 116 may prevent unwanted materials (e.g., surface water) from entering the main bore 110. The casing 116 may further prevent collapse of the main bore 110. Although FIG. 1 shows the main bore 110 as including the casing 116, the main bore 110 need not necessarily include any casing. For example, the main bore 110 or a portion of the main bore 110 may be an open-hole bore. To illustrate, a portion of the casing 116, surrounding the lateral junction 122 may be removed to create a casing exit during formation of the lateral bore 120. In other embodiments, open-hole portions of the main bore 110 may be protected by other means (e.g., a liner or liner sleeve as described herein).

The lateral bore 120 may be connected to the main bore 110 at the lateral junction 122. For example, the lateral bore 120 may have been formed by creating a casing exit at the lateral junction 122 and drilling away from the main bore 110. The lateral bore 120 may be an open-hole bore such that the lateral bore 120 does not include a casing. The lateral liner junction system 100 may be used to support an open-hole section of the main bore 110, an open-hole section of the lateral bore 120, or both as described herein.

The lateral liner junction system 100 may include a liner sleeve 130, a liner 132, a lock mechanism 134, and a docking mechanism 136. During formation of the lateral bore 120, the lateral liner junction system 100 may support portions of the well (e.g., open-hole portions) and may prevent drilled material and/or debris from entering the lower section 114 of the main bore 110. In that capacity, the lateral liner junction system 100 may include additional components (not shown) that may be useful for providing support to a well wall and for providing barriers.

The liner sleeve 130 may be installed proximate to the lateral junction 122 and may be movable between a first position and a second position. As shown in FIG. 1, while in the first position, the liner sleeve 130 may separate the upper section 112 and the lower section 114 of the main bore 110. For example, at least a portion of the liner sleeve 130 may be located inside the main bore 110 and at least a portion of the liner sleeve 130 may be located inside the lateral bore 120 such that the liner sleeve 130 straddles the lateral junction 122 connecting the upper section 112 of the main bore 110 to the lateral bore 120 and at least partially separating the lower section 114 of the main bore 110 from the upper section 112 of the main bore 110 and from the lateral bore 120.

The liner sleeve 130 may support an open-hole section of at least one of the main bore 110 and the lateral bore 120 while in the first position. Further, the liner sleeve 130 may prevent debris and/or drilled material from entering the lower section 114 of the main bore 110 during formation and completion of the lateral bore 120. By preventing debris and/or drilled material from entering the lower section 114 of the main bore 110, the liner sleeve 130 may protect one or more well assemblies (e.g., completion assemblies) within the lower section 114 of the main bore 110. The liner sleeve 130 may also guide tools and equipment used during the formation and completion of the lateral bore 120 such that the tools and equipment enter the lateral bore 120 instead of the lower section 114 of the main bore 110.

The liner 132 may be positioned within the lateral bore 120 and may be in contact with the liner sleeve 130 or otherwise connected to the liner sleeve 132. As shown in FIG. 1, a portion of the liner sleeve 130 may reside inside the liner 132 while another portion of the liner sleeve 130 resides outside the liner 132. Being inside the liner 132 may enable the liner sleeve 130 to selectively slide (i.e., telescope) into the liner 132. In other embodiments, the liner sleeve 130 may reside outside the liner 130 and may be displaced elsewhere within the lateral bore 120 without telescoping into the liner 132. Although FIG. 1 shows the liner sleeve 130 as being partially inserted into and overlapping the liner 132, in other embodiments, the liner sleeve 130 may contact the liner 132 only at an edge of the liner sleeve 132 and may be connected to the liner 132 via a shear ring, as described herein.

The lock mechanism 134 may be attached to the liner sleeve 130, the liner 132, or both. When enabled, the lock mechanism 134 may retain the liner sleeve 130 in the first position. When disabled, the lock mechanism 134 may enable selective displacement of the liner sleeve 130 from the first position to the second position. Various embodiments of the lock mechanism 134 are described further with reference to FIGS. 7-9.

The liner sleeve 130 and the liner 132 may be run to the lateral bore 120 with the lock mechanism 134 enabled. After the lateral bore 120 is formed, the lock mechanism 134 may be disabled. For example, disabling the lock mechanism 134 may include receiving an object at the liner sleeve 130 and shifting a release dog in response to the object. Shifting the release dog may cause the lock mechanism 134 to be disabled, enabling the liner sleeve 130 to be selectively displaced relative to the liner 132. The object may include at least one of a downhole ball, a dart, a downhole tool, another object usable for disabling a lock mechanism, or a combination thereof. In that respect, the object may be formed from a metal, a polymer, a dissolvable composite epoxy material (CEM), another type of material suitable for downhole use, or a combination thereof.

Another method of releasing the lock mechanism 134 may include generating a trigger at an electronic circuit of the locking mechanism and disabling the lock mechanism in response to the trigger. The electronic trigger may be generated in response to expiration of a timer, measuring a predetermined temperature at the liner sleeve, measuring a predetermined pressure at the liner sleeve, receiving a magnetic dart at the liner sleeve, another triggering event, or a combination thereof. Other mechanisms for generating an electronic trigger may be known to persons of ordinary skill in the relevant art having the benefit of this disclosure.

Figure 2:
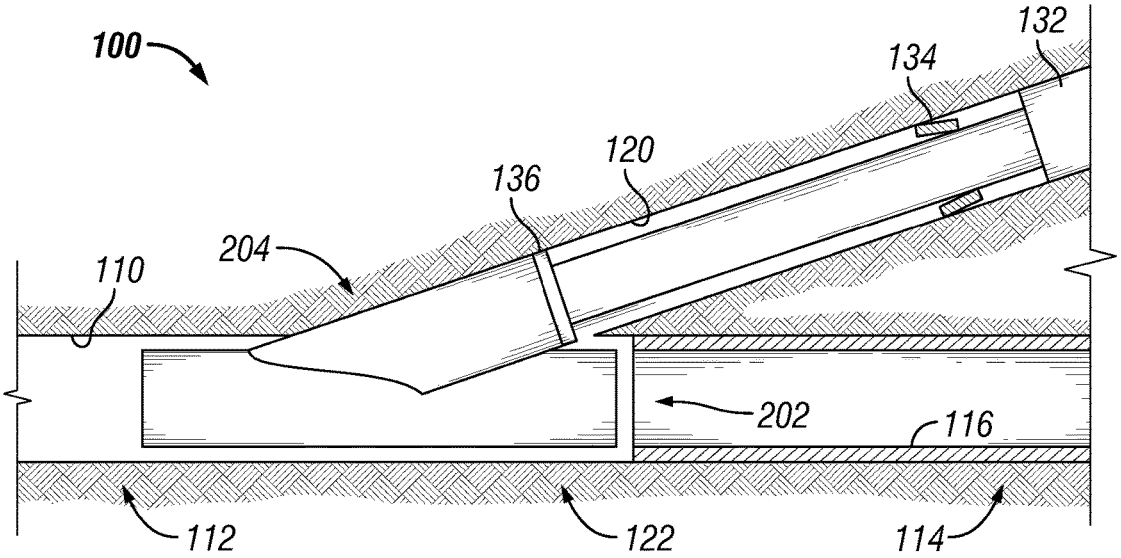
FIG. 2 depicts an embodiment of the lateral liner junction system in a second configuration.

Referring to FIG. 2, an embodiment of the lateral liner junction system 100 in a second configuration is depicted. In the second configuration, the lock mechanism 134 may be disabled. Further, the liner sleeve 130 may be docked with a lateral junction assembly 204. The liner sleeve 130 may be displaced to a second position and an opening 202 may connect the upper section 112 of the main bore 110 to the lower section 114 of the main bore.

One or more operations may be performed to place the lateral liner junction system 100 in the second configuration. The operations may include disabling the lock mechanism 134. For example, in one embodiment, disabling the lock mechanism 134 may include receiving an object at the liner sleeve 130 and shifting a release dog in response to the object as described herein. In another embodiment, disabling the lock mechanism 134 may include generating a trigger at an electronic circuit of the locking mechanism and unlocking the lock mechanism 134 in response to the trigger. Other methods of disabling the lock mechanism 134 may be known to persons of ordinary skill in the art having the benefit of this disclosure.

The operations may further include displacing the liner sleeve 130 from the first position to the second position. For example, at least a portion of the liner sleeve 130 may be slid from the main bore 110 or from the lateral junction 122 into the lateral bore 120. In an embodiment, at least a portion of the liner sleeve 130 is slid into the liner 132, thereby telescoping into the liner 132. Although FIG. 2 depicts the liner sleeve 120 as sliding into the liner 132, in one or more other embodiments, at least a portion of the liner may be slid, thereby displacing the liner sleeve 130. Further, at least a portion of a lateral completion within the lateral bore 120 may be slid, thereby displacing the liner sleeve 130. The liner sleeve 130 may be displaced using wireline or coil tubing tools. Examples of tools that may be used to displace the liner sleeve 130 include Baker Hughes' Model HB-1 Shifting Tool, Models HB-2 and HB-3 Selective Hydraulic Shifting Tools, and/or Model CM Selective Shifting Tool. Other methods of displacing the liner sleeve 130 may be known by persons of ordinary skill in the art having the benefit of this disclosure.

The liner sleeve 130 may be displaced when the lateral junction assembly 204 is run to the lateral junction 122. For example, the operations may further include attaching the liner sleeve 132 to the lateral junction assembly 204 using the docking mechanism 136 and running the lateral junction assembly 204 to the lateral junction 122. Because the liner sleeve 130 is attached to the lateral junction assembly 204, running the lateral junction assembly 204 may push the liner sleeve 130 from the first position to the second position.

The opening 202 may be formed when the liner sleeve 130 is displaced. For example, a portion of the liner sleeve 130 that separates the upper section 112 of the main bore 110 from the lower section 114 may be removed from the lateral junction 122 and stowed in the lateral bore 120, thereby no longer separating the upper section 112 from the lower section 114. Hence, the opening 202 may connect the upper section 112 of the main bore 110 with the lower section 114 of the main bore 110.

Figure 3:
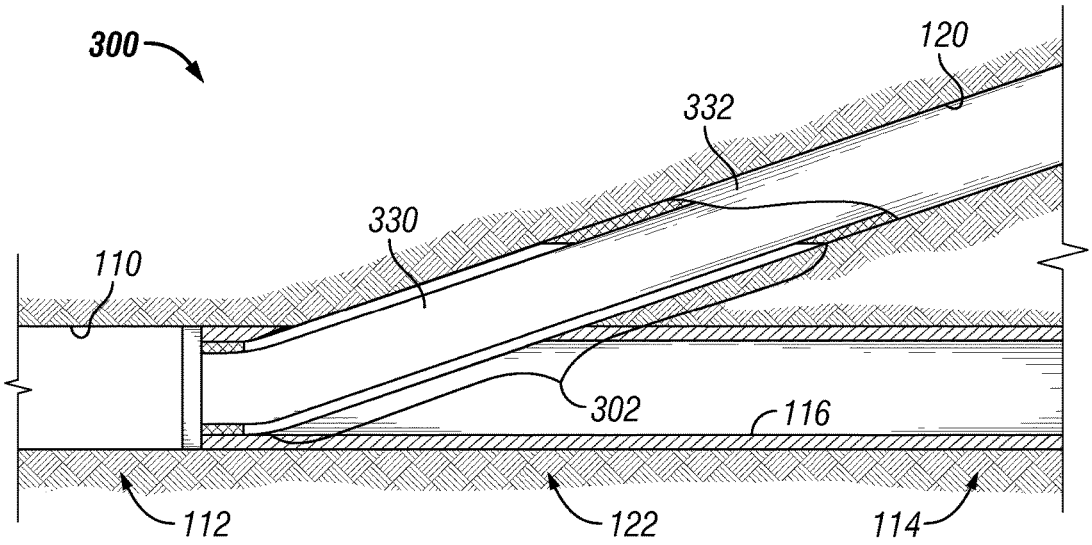
FIG. 3 depicts another embodiment of a lateral liner junction system in a first configuration.

Referring to FIG. 3, an embodiment of a lateral liner junction system 300 in a first configuration is depicted. Similar to the lateral liner junction system 100, the lateral liner junction system 300 may be located at least partially within the main bore 110 and at least partially within the lateral bore 120. During formation of the lateral bore 120, the lateral liner junction system 300 may support portions (e.g., open-hole portions) of the main bore 110, portions of the lateral junction 122, and/or portions of the lateral bore 120 and may prevent drilled material and/or debris from entering the lower section 114 of the main bore 110.

The lateral liner junction system 300 may include a liner sleeve 330 and a liner 332. The liner sleeve 330 may reside inside the liner 332 and may be installed (along with the liner 332) proximate to the lateral junction 122. The liner sleeve 330 may be selectively movable within the liner 332 between a first position and a second position. Although, not shown in FIG. 3, in an embodiment, the lateral junction system 300 may include the lock mechanism 134. When enabled, the lock mechanism 134 may retain the liner sleeve 330 in the first position. When disabled, the lock mechanism 134 may enable selective displacement of the liner sleeve 330 from the first position to the second position.

The liner 332 may include a window 302 defined therein. The window 302 may be overlapped by at least a portion of the liner sleeve 330 while the liner sleeve 330 is in the first position. By overlapping the window 302, the liner sleeve 330 may separate the upper section 112 of the main bore 110 from the lower section 114 of the main bore 110. For example, the liner 332 may be place at the lateral junction 122 such that the window 302 is positioned over the lower section 114 as shown in FIG. 3. The liner sleeve 330 may overlap (i.e., cover) the window 302. By covering the window 302, the liner sleeve 330 may prevent drilled material and debris from entering the lower section 114 of the main bore 110 during formation and completion of the lateral bore 120. The liner sleeve 330 may also guide tools and equipment used during the formation and completion of the lateral bore 120 such that the tools and equipment enter the lateral bore 120 instead of the lower section 114 of the main bore 110. The liner sleeve 330 may be moved to the second position to open the window 302 permitting access to the lower section 114 of the main bore 110 after completion operations on the lateral bore 120 are done as shown and discussed in regards to FIG. 4.

Figure 4:
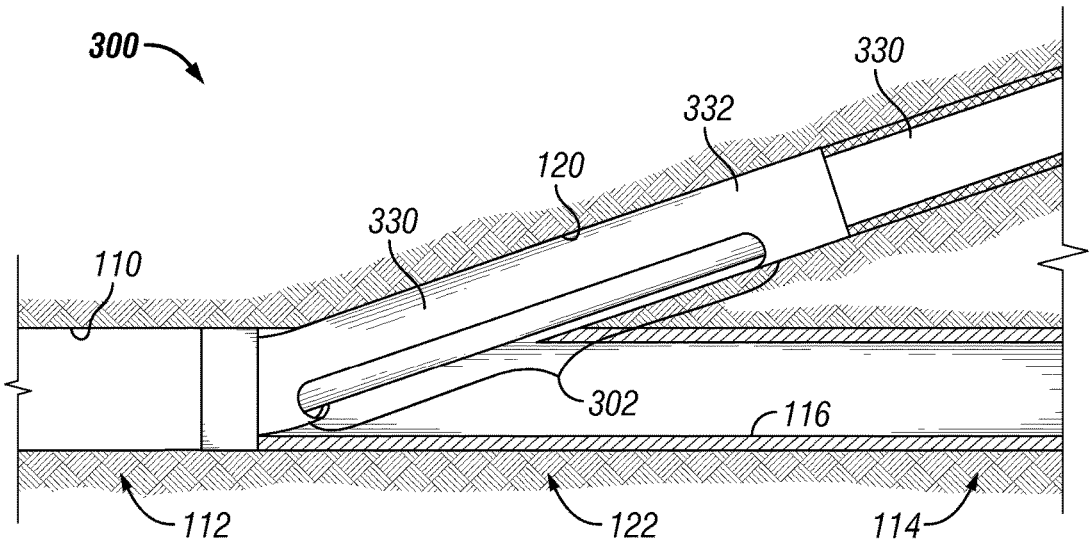
FIG. 4 depicts the other embodiment of the lateral liner junction system in a second configuration.

Referring to FIG. 4, an embodiment of the lateral liner junction system 300 in a second configuration is depicted. In the second configuration, the liner sleeve 330 may be displaced to the second position such the window 302 is at least partially uncovered. For example, displacing the liner sleeve 330 may remove at least a portion of an overlap between the liner sleeve 330 and the window 302. An opening 402, formed by uncovering the window 302 may connect the upper section 112 of the main bore 110 with the lower section 114 of the main bore 110. For example, as depicted in FIG. 4, at least a portion of the liner sleeve 330 may not overlap the window 302 while the liner sleeve is in the second position.

One or more operations may be performed to place the lateral liner junction system 300 in the second configuration. In embodiments that include the lock mechanism 134, the operations may include disabling the lock mechanism 134 as described herein. The operations may further include displacing the liner sleeve 330 to the second position. For example, the liner sleeve 330 may be slid within the liner 332 from the first position to the second position, as shown in FIG. 4.

Although FIG. 4 depicts the liner sleeve 330 as being pushed into the lateral bore 120, in other embodiments the liner sleeve 330 may be rotated to the second position. For example, the liner sleeve 330 may include a window defined therein such that when the liner sleeve 330 is in the first position, the window in the liner sleeve 330 is not aligned with the window 302 in the liner 332. By rotating the liner sleeve 330 to the second position, the window in the liner sleeve 330 may be aligned with the window 302 in the liner 332, thereby forming the opening 402.

As described herein, examples of tools that may be used to displace the liner sleeve 330 include Baker Hughes' Model HB-1 Shifting Tool, Models HB-2 and HB-3 Selective Hydraulic Shifting Tools, and/or Model CM Selective Shifting Tool. Other methods of displacing the liner sleeve 330 may be known by persons of ordinary skill in the art having the benefit of this disclosure. Although not shown in FIG. 4, the liner sleeve 330 may be displaced when the lateral junction assembly 204 is run to the lateral junction 122, as described herein.

Figure 5:
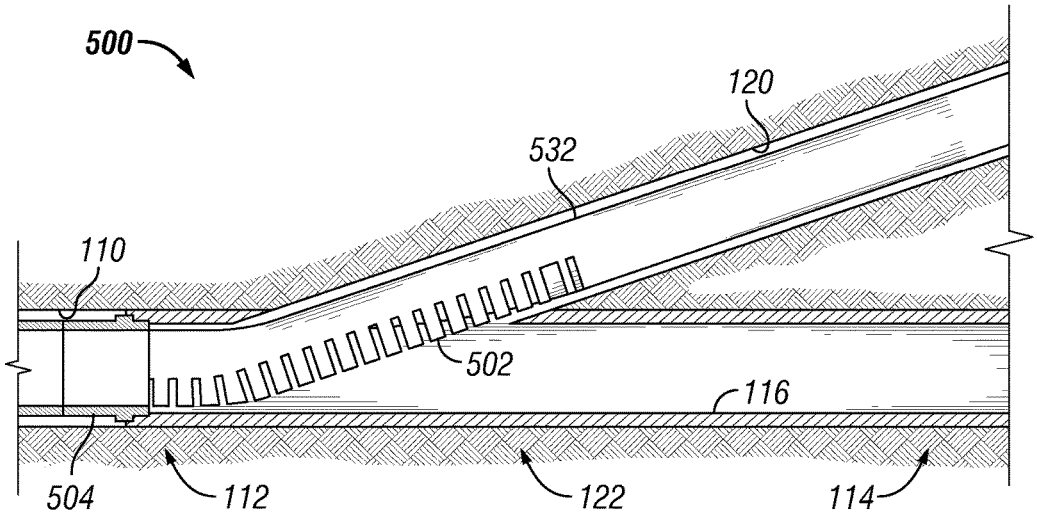
FIG. 5 depicts another embodiment of a lateral liner junction system.

Referring to FIG. 5 an embodiment of a lateral liner junction system 500 is depicted. The lateral liner junction system 500 may include a liner 532. The liner 532 may be installed proximate to the lateral junction 122 and may separate the upper section 112 and the lower section 114 of the main bore 110. For example, at least a portion of the liner 532 may be located inside the main bore 110 and at least a portion of the liner 532 may be located inside the lateral bore 120 such that the liner 532 straddles the lateral junction 122 connecting the upper section 112 of the main bore 110 to the lateral bore 120 and separating the lower section 114 of the main bore 110 from the upper section 112 of the main bore 110 and from the lateral bore 120.

The liner 532 may include a barrier portion that separates the upper section 112 of the main bore 110 from the lower section 114 of the main bore. For example, the barrier portion may be positioned over the lower section 114 of the main bore 110. The barrier portion may act predictably upon structural failure (e.g., breaking or tearing) of the barrier portion. For example, the barrier portion may include the one or more support bands 502. The one or more bands may be configured to break upon receiving a swage 504 or other device or expansion mechanism through the liner 532. Breaking the one or more support bands 502 may connect (i.e., remove the barrier) the upper section 112 of the main bore 110 and the lower section 114 of the main bore 110, as described herein. Although FIG. 5 depicts the barrier portion as including one or more support bands 502, in one or more other embodiments, the barrier portion may include one or more thin sections configured to control structural failure in a predictable manner upon receiving the swage 504. Further, in one or more other embodiments, the barrier portion may include one or more pre-stress induced locations configured to control structural failure in a predictable manner.

Figure 6A:
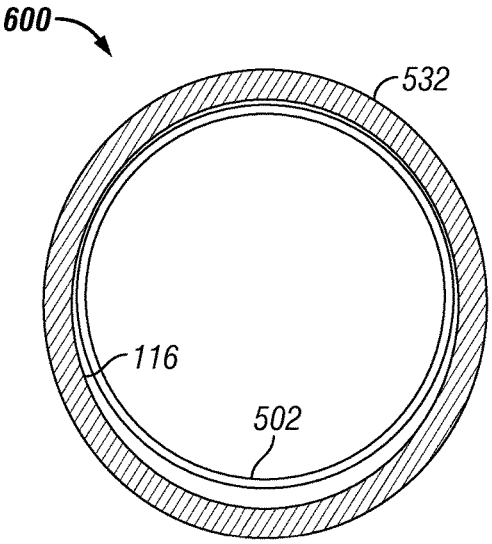
FIG. 6A depicts an embodiment of a first state of the lateral liner junction system of FIG. 5.

Referring to FIG. 6A an embodiment of a first state 600 of the lateral liner junction system 500 described herein is depicted. The lateral liner junction system 500 may be positioned at the lateral junction 122. In this case, the casing 116 may be elongated in one direction due to the lateral bore 120 branching from the main bore 110. For example, at the point of the lateral junction 122, the main bore 110 and the lateral bore 120 may combine to form an elongated bore. The barrier portion including the bands 502 may be positioned over the main bore 110 such that, when unbroken, the barrier portion separates the upper section 112 of the main bore from the lower section 114 of the main bore 110. Hence, in the first state 600, the liner 532 may be in a first configuration and may prevent drilled material and/or debris from entering the lower section 114 of the main bore 110. The liner 532 may also guide tools and equipment used during the formation and completion of the lateral bore 120 such that the tools and equipment enter the lateral bore 120 instead of the lower section 114 of the main bore 110. Although, FIG. 6A depicts the casing 116 as surrounding the liner 532, in other wells, all or a portion of the well may be an open-hole type well.

Figure 6B:
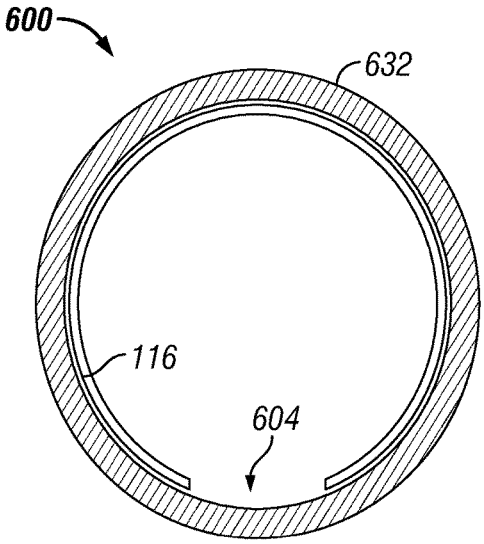
FIG. 6B depicts an embodiment of a second state of the lateral liner junction system of FIG. 5.

Referring to FIG. 6B, an embodiment of a second state 650 of the lateral liner junction system 500 described herein is depicted. In the second configuration of the liner 532, the barrier portion (e.g., the one or more bands 502) may be broken defining an opening 604. The opening may connect (i.e., unseparate) the upper section 112 and the lower section 114 of the main bore 110. As depicted in FIG. 6B, the opening 604 may be expanded to allow access between the upper section 112 and the lower section 114.

One or more operations may be performed to place the lateral liner junction system 500 in the second state 650. The operations may include receiving a swage 504, or other device, through the liner. The barrier portion may be broken in response to receiving the swage 504. Breaking the barrier portion may form the opening 604.

The operations may further include expanding the opening 604. For example, the barrier portion may be configured to expand upon breaking to enlarge the opening 604. As another example, a lateral junction assembly (e.g., the lateral junction assembly 204) may be run to the lateral junction 122. Running the lateral junction assembly may cause the opening 604 to expand as the lateral junction assembly is pushed through the opening 604. Other systems and methods usable to expand the opening 604 may be known to persons of ordinary skill in the art having the benefit of this disclosure.

Figure 7:
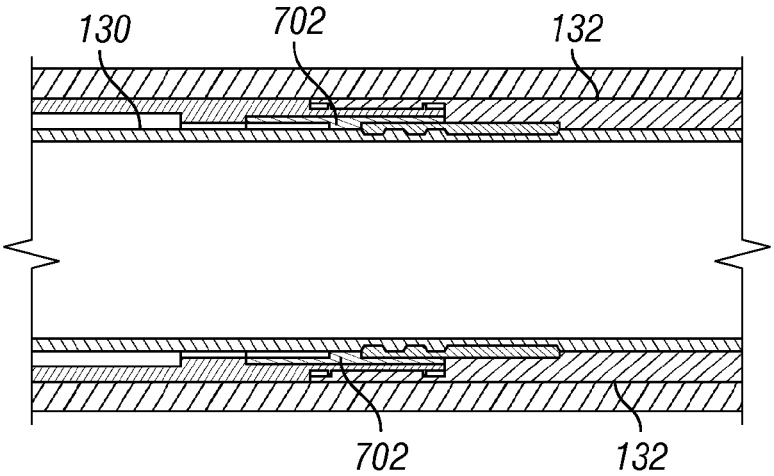
FIG. 7 depicts an embodiment of a lock mechanism usable with a lateral liner junction system.

Referring to FIG. 7, an embodiment of a lock mechanism usable with at least one of the lateral liner junction systems 100, 300 is depicted. The lock mechanism of FIG. 7 includes a shear ring 702. The shear ring 702 may couple the liner sleeve 130 to the liner 132. The shear ring may be disabled by performing a straight pull operation at the liner sleeve 130, by performing a rotation operation of the liner sleeve 130, by applying an internal pressure at the liner sleeve 130, or by a combination thereof.

Figure 8:
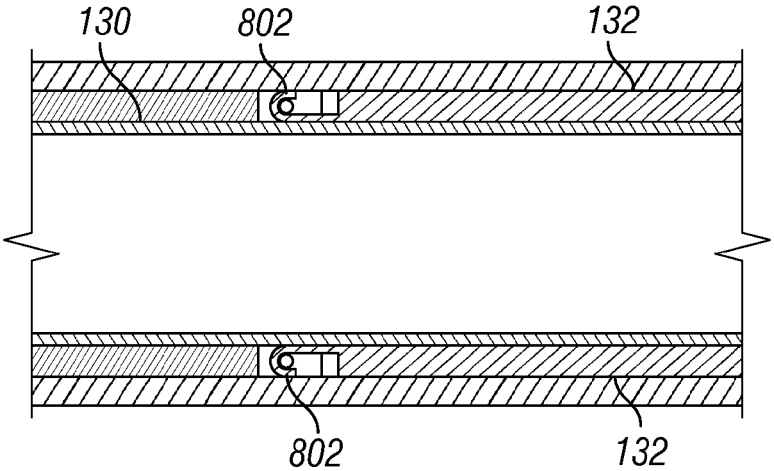
FIG. 8 depicts an embodiment of a lock mechanism usable with a lateral liner junction system.

Referring to FIG. 8 an embodiment of a lock mechanism usable with at least one of the lateral liner junction systems 100, 300 is depicted. The lock mechanism of FIG. 8 includes a J-type latch 802. The J-type latch may include a J-shaped member configured to attach to a shaft when the lock is activated and release from the shaft when the lock is disabled. Additional features of a J-type latch may be known to persons of ordinary skill in the art having the benefit of this disclosure.

Figure 9:
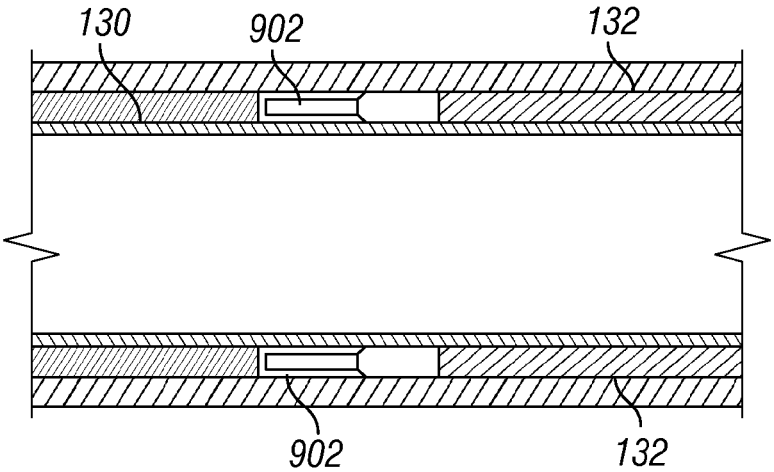
FIG. 9 depicts an embodiment of a lock mechanism usable with a lateral liner junction system.

Referring to FIG. 9, an embodiment of a lock mechanism usable with at least one of the lateral liner junction systems 100, 300 is depicted. The lock mechanism of FIG. 9 includes a hydrostatic chamber 902. A pressure may be applied to the hydrostatic chamber 902 to enable the lock mechanism and the pressure may be reduced to disable the lock mechanism. When enabled, the hydrostatic chamber 902 may couple the liner sleeve 130 to the liner 132. Additional features of a hydrostatic chamber may be known to persons of ordinary skill in the art having the benefit of this disclosure.

Although FIGS. 7-9 depict the lock mechanism as including one of a shear ring, a J-type latch, and a hydrostatic chamber, in other embodiments, a lock mechanism usable with the lateral liner junction system 100 may include a combination of one or more of a shear ring, a J-type latch, a hydrostatic chamber, and another type of locking device.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

What is claimed is:

1. A lateral junction liner system comprising:

a liner sleeve proximate to a junction between a lateral bore and a main bore of a well, the liner sleeve movable between a first position and a second position, wherein the liner sleeve separates an upper section of the main bore from a lower section of the main bore while in the first position;

a liner positioned at least partially within the lateral bore and in contact with the liner sleeve, wherein at least a portion of the liner sleeve resides outside the liner when the liner sleeve is in the first position and resides inside the liner when the liner sleeve is in the second position;

a lock mechanism attached to the liner sleeve that, when enabled, retains the liner sleeve in the first position and that, when disabled, enables selective displacement of the liner sleeve from the first position to the second position; and a drill string positioned within the liner sleeve, the liner sleeve preventing drilling debris from entering the lower section of the main bore when in the first position.

2. The system of claim 1, wherein the lock mechanism comprises a shear ring coupling the liner sleeve to the liner.

3. The system of claim 2, wherein the shear ring is disabled by a straight pull at the liner sleeve, by rotation of the liner sleeve, by an internal pressure of the liner sleeve, or by a combination thereof.

4. The system of claim 1, wherein the lock mechanism comprises a j-type mechanical latch, a mechanically or hydraulically activated hydrostatic chamber, or a combination thereof.

5. The system of claim 1, wherein the liner includes a window defined therein, the window overlapped by at least a portion of the liner sleeve while the liner sleeve is in the first position, and wherein the at least the portion of the liner sleeve does not overlap the window while the liner sleeve is in the second position.

6. The system of claim 1, wherein the liner sleeve supports an open-hole section of at least one of the main bore and the lateral bore while in the first position.

7. A method of installing a lateral junction assembly at a lateral junction of a well, the method comprising:

positioning a liner and a liner sleeve proximate to a junction between a lateral bore and a main bore of a well, wherein the liner sleeve is movable between a first position and a second position, wherein the liner sleeve separates an upper section of the main bore from a lower section of the main bore while in the first position, wherein the liner is positioned at least partially within the lateral bore, and wherein the liner is in contact with the liner sleeve;

performing a drilling operation to form or extend the lateral bore, the liner sleeve preventing drilling debris from entering the lower section of the main bore during the drilling operation;

disabling a lock mechanism coupled to the liner sleeve wherein the lock mechanism, when enabled, retains the liner sleeve in the first position and, when disabled, enables selective displacement of the liner sleeve from the first position to the second position; and displacing the liner sleeve to the second position to unseparate the upper section of the main bore and the lower section of the main bore, wherein at least a portion of the liner sleeve is within the lateral bore while the liner sleeve is at the second position.

8. The method of claim 7, wherein disabling the lock mechanism comprises disabling a shear ring coupling the liner sleeve to the liner.

9. The method of claim 8, wherein disabling the shear ring comprises performing a straight pull operation at the liner sleeve, performing a rotation operation at the liner sleeve, applying an internal pressure at the liner sleeve, or a combination thereof.

10. The method of claim 7, wherein disabling the lock mechanism comprises:

receiving an object at the liner sleeve; and shifting a release dog in response to the object.

11. The method of claim 10, wherein the object comprises at least one of a ball, a dart, and a downhole tool.

12. The method of claim 10, wherein the object is formed from a metal, a polymer, a dissolvable composite epoxy material, or a combination thereof.

13. The method of claim 10, wherein disabling the lock mechanism comprises:

generating a trigger at an electronic circuit of the locking mechanism; and disabling the lock mechanism in response to the trigger.

14. The method of claim 13, wherein the electronic trigger is generated in response to expiration of a timer, measuring a predetermined temperature at the liner sleeve, measuring a predetermined pressure at the liner sleeve, receiving a magnetic dart at the liner sleeve, or a combination thereof.

15. The method of claim 7, wherein displacing the liner sleeve to the second position comprises sliding at least a portion of the liner sleeve into the lateral bore.

16. The method of claim 7, wherein displacing the liner sleeve to the second position comprises sliding at least a portion of the liner sleeve into the liner.

17. The method of claim 7, wherein displacing the liner sleeve to the second position comprises sliding at least a portion of the liner.

18. The method of claim 7, wherein displacing the liner sleeve to the second position comprises sliding at least a portion of a lateral completion.

19. The method of claim 7, wherein displacing the liner sleeve to the second position is performed using wireline or coil tubing tools.

20. The method of claim 7, wherein displacing the liner sleeve removes at least a portion of an overlap between the liner sleeve and a window defined within the liner.

21. The method of claim 7, further comprising attaching the liner sleeve to a lateral junction assembly at a docking mechanism of the liner sleeve.

22. The method of claim 21, further comprising running the lateral junction assembly to the lateral junction, wherein running the lateral junction assembly pushes the liner sleeve from the first position to the second position.

* * * * *